US005682010A

United States Patent [19]

Embury, Jr.

[11] Patent Number: 5,682,010

[45] Date of Patent: Oct. 28, 1997

[54] METHOD FOR CREATING A ONE WAY VISIBLE SCREENING SMOKE

[75] Inventor: Janon F. Embury, Jr., Towson, Md.

[73] Assignee: The United States of America as represented by the Secretary of the Army, Washington, D.C.

[21] Appl. No.: 772,056

[22] Filed: Dec. 4, 1996

[51] Int. Cl.[6] ..... C06D 3/00

[52] U.S. Cl. ..... 102/334

[58] Field of Search ..... 102/334

[56] References Cited

U.S. PATENT DOCUMENTS

| | | | |
|---|---|---|---|
| 4,697,521 | 10/1987 | Espagnacq et al. | 102/334 |
| 4,719,857 | 1/1988 | Spring | 102/334 |
| 4,724,018 | 2/1988 | Espagnacq et al. | 102/334 |
| 4,732,085 | 3/1988 | Gershenson et al. | 102/334 |
| 5,340,395 | 8/1994 | Larmignat et al. | 102/334 X |
| 5,425,310 | 6/1995 | Weber | 102/342 |
| 5,454,324 | 10/1995 | Larmignat et al. | 102/334 |
| 5,610,359 | 3/1997 | Spector et al. | 89/1.11 |

*Primary Examiner*—Peter A. Nelson
*Attorney, Agent, or Firm*—Ulysses John Biffoni

[57] ABSTRACT

A method of producing a visible one-way screening smoke is disclosed. The method includes substantially concurrently deploying into ambient atmosphere a first smoke cloud containing a light absorbent material such as carbon black and a second smoke cloud containing a white nonabsorbent visible screening smoke substantially parallel to and apart from the first cloud so that a two layer obscurant cloud having a one-way visibility effect is created in which visibility is substantially maintained only in the direction of the first cloud through the second cloud.

19 Claims, No Drawings

METHOD FOR CREATING A ONE WAY VISIBLE SCREENING SMOKE

GOVERNMENT INTEREST

The invention described herein may be manufactured, licensed, and used by or for the U.S. Government.

BACKGROUND OF THE INVENTION

1. Field of the Invention

The present invention relates to methods for preparing improved screening smokes. In particular, the invention relates to methods of preparing screening smokes which selectively obscure vision in one direction.

2. Description of the Prior Art

Efforts to develop minimum hazard visual screening clouds or smoke screens which help to protect military equipment from visual detection and allow safe training or maneuvering have been under development for a number of years. For example, various military vehicles are equipped with smoke grenades and launchers which provide an instantaneous visual screening "puff" cloud relative to the vehicle shortly after activation while continuous sources such as large area smoke generators and smoke pots produce a downwind screening plume-shaped cloud. One of the primary limitations associated with currently available smoke screen techniques is the fact that the screening smokes often severely limit the field of vision of the parties who deploy the screen. Thus, while the smoke deploying party can effectively keep its position and maneuvers hidden from an enemy, the deploying party, at the same time, is often unable to determine whether the party against whom the screen has been deployed has moved or otherwise changed its position in the field. In view of this shortcoming, it would be most advantageous if a screening smoke could be developed which would selectively allow the deploying party to substantially maintain their field of vision toward the enemy while at the same time substantially curtail the vision of the enemy toward the smoke deploying party. The present invention addresses this need.

SUMMARY OF THE INVENTION

The present invention includes a method of producing a visible one-way screening smoke. The method comprises substantially concurrently deploying into ambient atmosphere a first smoke cloud containing a dispersed absorbent (black) material and a second smoke cloud containing a nonabsorbing (white) visible screening smoke material substantially parallel to and apart from the first cloud. The method thus provides an obscurant smoke having a one-way visibility effect in which visibility is substantially maintained only in the direction of the first cloud through to the second cloud. The cloud can either take the form of a puff (roughly hemispheric) shape, generated instantaneously by an explosive dissemination process or a plume shape from a continuous generation process such as that used by large area smoke generators and smoke pots.

As a result of the present invention there is provided an advance in the field of smoke screen technology. In particular, there is provided a method to produce a visible screening smoke that obscures images more effectively on the enemy side of the smoke screen than on the opposite or friendly side of the smoke screen. Thus, the smoke screen deploying party can obtain the benefits of smoke cover to elude an enemy or carry out maneuvers without losing sight of the enemy who cannot see through the obscurant smoke.

A second advantage of the present invention is the fact that the method provides a cost effective alternative to thermal or "night vision" detection systems which would otherwise be required in order to maintain intelligence concerning the movements of an enemy after deploying the screening smoke.

For purposes of describing the present invention, "cloud" is used in conjunction with describing certain aspects of the screening smoke. It will be understood by those of ordinary skill in the art that, for purposes of description, the term "cloud" includes "plume", explosively dispersed puff (spherical) clouds and continuously generated plumes which are approximately half-cone-shaped clouds.

DETAILED DESCRIPTION OF THE PREFERRED EMBODIMENT

According to the present invention, there is provided a method of producing a visible one-way screening smoke. The method comprises substantially concurrently deploying a first and a second smoke cloud into ambient atmosphere so that the first and second smoke clouds are substantially apart from one another and form an obscurant smoke-cloud having a one-way visibility effect for lines of sight passing through both clouds. In particular, the method provides a two layer screening smoke which substantially allows the field of vision to be maintained in the direction through the first smoke cloud then through the second smoke cloud but not vice verse.

According to the invention, the ability of a party, i.e. an enemy, to view the smoke deploying or "friendly" party through the two layer smoke by peering along a line of sight passing through the second smoke cloud and then the first smoke cloud is substantially impaired while the ability of a friendly party on the opposite side of the smoke layers is not substantially impaired. The first smoke cloud is generated with a visible light absorbing dispersed material such as carbon black or graphite flake and the second smoke cloud is generated with nonabsorbing dispersed materials such as titanium dioxide or fog oils. The one way visibility effect is effectively diminished by the mixing of the two clouds and goes away completely when the clouds are entirely mixed.

While Applicant is not bound by theory, the one-way visible smoke screen effect is apparent from the differences in the maximum contrast images available to viewers positioned on opposite sides of the two layer smoke clouds. The maximum contrast images transmitted through the two layer smoke clouds obtained by an observer positioned on the enemy side or in the closest proximity to the second (nonabsorbing) smoke cloud, containing the aerosolized titanium dioxide dispersion for example, is substantially less than the maximum contrast images transmitted through the two smoke clouds obtained by an observer positioned on the friendly or smoke deploying side, i.e. the observer in closest proximity to the first (absorbing) smoke cloud. The foregoing rationale is based at least in part on the premise that each observer is attempting to view the other through the two layer screening smoke and that the amount of ambient illumination scattered into the eyes of the respective observers from the two smoke clouds will be substantially different on opposite sides of the two layer screening smoke due to the different ratio of scatter over absorption in the two layers. The friendly observer will generally have less scattered light (glare) superimposed onto his line of sight than the enemy observer on the opposite side.

In operation, the two smoke clouds are substantially concurrently generated from separate suitable smoke generating apparatus such as those well known to those of ordinary skill in the art such as smoke grenades that use explosive dissemination, large area smoke generators using pneumatic or vaporization/condensation dissemination and smoke pots using pyrotechnic dissemination. The individual generators are positioned sufficiently apart from one another so the respective smoke clouds exiting the generators are maintained in a substantially distinct or separate and substantially parallel arrangement downwind from their respective generators for at least as long as is necessary to obscure the desired area with the one-way screening smoke. Similarly, pairs of puff-shaped clouds must be separate and distinct. It will be understood that the distance between the respective smoke clouds will vary somewhat depending upon the ambient atmospheric conditions and that the amount of smoke generated by each generator will have to be maintained at a relatively constant rate in order to maintain the two layers or clouds of smoke and replace the smoke from each cloud which will naturally dissipate downwind. Under typical operating conditions, the smoke generators will be separated by a crosswind distance equal to about one third the downwind distance to the crosswind line of sight to be obscured and the downwind distance from both generators to the line of sight will be equal. Given the foregoing parameters, the method of the present invention will generate one way visible screening smoke plume having a height equal to about one tenth the downwind distance. Furthermore, while the height of the individual smoke clouds will vary depending upon the needs of the deploying party, it has been determined that individual clouds, when arranged as described above, i.e. apart and parallel to each other, are sufficient to achieve the desired effect. Thus, it can be seen that the method provides sufficiently high and dense smoke screens to allow the deploying party to evade detection. In one preferred aspect of the invention, the first smoke cloud and the second smoke cloud are deployed in a continuous fashion pyrotechnically, pneumatically or by vaporization/condensation in such a way that the two smoke clouds do not overlap at the distance downwind intercepting the crosswind line of sight. A rough role of thumb would put the smoke generators a distance equal to one third the downwind distance intercepting the line of sight.

The individual smoke clouds which comprise the one-way smoke screen of the present invention are also deemed to be independently illuminated in the sense that neither smoke cloud substantially influences the level of ambient illumination experienced by the other, although this is not a necessary condition for one way visibility. In fact, one way visibility can be further improved for dependent illumination where each cloud influences illumination of the other. It will also be understood that since the two smoke clouds are directed from independent sources into the atmosphere that the individual clouds will eventually intermingle and/or dissipate in the atmosphere. A key to the present invention, however, is that the individual smoke clouds do not mix over the predetermined area and are arranged so that the two layer, one-way vision effect is achieved over a limited and predetermined area, such as an encampment. The ability to achieve this effect with the method described herein will be apparent from the description provided herein and ordinary skill in the camouflage art with routine rather than undue experimentation. By employing the substantially parallel smoke clouds over a desired area, it will be appreciated that a one-way screening cloud of a desired size will be formed so as to selectively screen a relatively wide area from enemy view.

The first smoke cloud contains a light absorbing material such as carbon black or graphite flake. The smoke cloud, and consequently, the first portion of the one way screening cloud, can be generated by explosively, pneumatically or pyrotechnically dispersing the carbon black powder or the graphite flake. The particles in the dispersion will preferably be sized under about 0.2 microns in diameter for carbon black and under about 0.2 microns in thickness for graphite flake.

The second smoke cloud containing the visible screening smoke is preferably formed by explosively, pneumatically or pyrotechnically dispersing fine titanium dioxide powder in which the particles are of a submicron diameter and preferably substantially spherical in shape. It has been found that titanium dioxide particles provide an effective visual screening cloud and that effective aerosolizing of such particles can be accomplished by using particles with a narrow size distribution centered on about 0.25 microns.

As an alternative, the second smoke cloud can be generated by using fog oil, diesel or a petroleum-based fuel which is aerosolized in a manner such as disclosed in United States Statutory Invention Registration No. H1208, the contents of which are incorporated herein by reference. The fog oil, diesel or petroleum-based fuel liquid aerosol droplet size distribution should be narrow and centered on or about 0.7 microns in diameter for the most effective visible screening. Pyrotechnically disseminated white phosphorus droplets of this size are another alternative.

While there have been described what is believed to the preferred embodiment of the present invention, it will be understood that various modifications can be made thereto without departing from the scope and spirit of the invention. It is therefore intended that all such modifications be embraced by the appended claims.

What is claimed is:

1. A method of producing a visible one-way screening smoke, comprising substantially concurrently deploying into ambient atmosphere a first smoke cloud containing a dispersed absorbent material and a second smoke cloud containing a visible non-absorbing screening smoke material substantially parallel to and apart from said first cloud, whereby an obscurant cloud having a one-way visibility effect is created in which visibility is substantially maintained for observers in the direction through said first cloud and then through said second cloud.

2. The method of claim 1, wherein said absorbent material in said first cloud is carbon black.

3. The method of claim 1, wherein said absorbent material in said first cloud is graphite flake.

4. The method of claim 1, wherein said visible screening smoke in said second cloud comprises titanium dioxide particles.

5. The method of claim 1, wherein said visible screening smoke in said second cloud comprises white phosphorus droplets.

6. The method of claim 2, wherein said carbon black particles are of a diameter under about 0.2 microns.

7. The method of claim 3, wherein said graphite flake particles are of a thickness under about 0.2 microns.

8. The method of claim 4, wherein said titanium dioxide particles are of a narrow size distribution centered on about 0.25 microns in diameter.

9. The method in claim 5, wherein said white phosphorus droplets are of a narrow size distribution centered on about 0.7 microns in diameter.

10. The method of claim 1, wherein said visible screening smoke in said second cloud is generated by a fog oil.

11. The method of claim 10, wherein said fog oil droplets are of a narrow size distribution centered at about 0.7 microns in diameter.

12. The method of claim 1, wherein said visible screening smoke in said second cloud is generated by diesel fuel.

13. The method of claim 12, wherein said diesel fuel droplets are of a narrow size distribution centered at about 0.7 microns in diameter.

14. The method of claim 1, wherein said visible screening smoke in said second cloud is generated by a petroleum fuel.

15. The method of claim 14, wherein said petroleum fuel droplets are of a narrow size distribution centered at about 0.7 microns in diameter.

16. The method of claim 1, wherein said first smoke cloud and said second smoke cloud are deployed explosively about 30 meters apart from each other along the line of sight.

17. The method of claim 1, wherein said first smoke cloud and said second smoke cloud are deployed in a continuous fashion pyrotechnically whereby the two smoke clouds do not overlap at the distance downwind intercepting the crosswind line of sight.

18. The method of claim 1, wherein said first smoke cloud and said second smoke cloud are deployed in a continuous fashion pneumatically whereby the two smoke clouds do not overlap at the distance downwind intercepting the crosswind line of sight.

19. The method of claim 1, wherein said first smoke cloud and said second smoke cloud are deployed in a continuous fashion by vaporization/condensation whereby the two smoke clouds do not overlap at the distance downwind intercepting the crosswind line of sight.

* * * * *